US011312465B2

(12) United States Patent
Zhang

(10) Patent No.: US 11,312,465 B2
(45) Date of Patent: Apr. 26, 2022

(54) TAIL RUDDER CONTROL SYSTEM AND KAYAK

(71) Applicant: NINGBO HAISHU HONGHUI MOLD & PLASTIC FACTORY, Ningbo (CN)

(72) Inventor: Guochun Zhang, Ningbo (CN)

(73) Assignee: NINGBO HAISHU HONGHUI MOLD & PLASTIC FACTORY, Zhejiang (CN)

( * ) Notice: Subject to any disclaimer, the term of this patent is extended or adjusted under 35 U.S.C. 154(b) by 0 days.

(21) Appl. No.: 16/829,108

(22) Filed: Mar. 25, 2020

(65) Prior Publication Data

US 2021/0129969 A1 May 6, 2021

(51) Int. Cl.
*B63H 25/10* (2006.01)
*B63H 25/38* (2006.01)

(52) U.S. Cl.
CPC ..... *B63H 25/10* (2013.01); *B63H 25/38* (2013.01)

(58) Field of Classification Search
CPC ..... B63H 25/00; B63H 25/06; B63H 25/10; B63H 25/38; B63H 25/42; B63H 25/44; B63H 16/00; B63H 16/18; B63H 16/20
USPC ..... 114/144 R, 162, 165, 347
See application file for complete search history.

(56) References Cited

U.S. PATENT DOCUMENTS 2,991,749 A 7/1961 Patterson
4,556,006 A * 12/1985 Kaupat ..... B63H 25/382 114/144 R
4,735,165 A 4/1988 Baba et al.
5,460,551 A * 10/1995 Beres ..... B63H 16/14 114/347
6,739,276 B1 5/2004 Rard
7,430,976 B2 * 10/2008 Ketterman ..... B63H 25/38 114/165
8,082,871 B2 * 12/2011 Czarnowski ..... B63B 7/08 114/347

(Continued)

FOREIGN PATENT DOCUMENTS

EP 2607228 A1 6/2013
WO 2008016681 A2 2/2008

OTHER PUBLICATIONS

European Search Report issued in corresponding European Patent Application No. 20191238.8 dated Mar. 10, 2021.

*Primary Examiner* — Lars A Olson
(74) *Attorney, Agent, or Firm* — Finch & Maloney, PLLC; Michael Bujold; Jay Franklin

(57) ABSTRACT

The present invention provides a tail rudder control system for a kayak which includes a tail rudder assembly, having a tail rudder, a swing mechanism for driving the tail rudder to rotate in the horizontal direction, a traction mechanism for driving the tail rudder to flip longitudinally for storage, and a guide wheel box for driving the swing mechanism and reset the tail rudder. Two pedal assemblies are in transmission connection with the swing mechanism through a steering traction line for driving the swing mechanism to act. A transmission assembly includes a first transmission wheel wound with a transmission traction line, a second transmission wheel wound with a reverse traction line. The second transmission wheel is driven by the first transmission wheel, and the reverse traction line is in transmission connection with the traction mechanism for driving the traction mechanism to act.

12 Claims, 12 Drawing Sheets

(56) References Cited

U.S. PATENT DOCUMENTS

| | | | | |
|---|---|---|---|---|
| 8,100,075 | B2 * | 1/2012 | Wang | B63H 25/10<br>114/162 |
| 8,753,156 | B2 * | 6/2014 | Ketterman | B63H 25/42<br>440/26 |
| 10,926,852 | B2 * | 2/2021 | Kramer | B63H 25/44 |
| 2002/0069809 | A1 | 6/2002 | King et al. | |

* cited by examiner

TAIL RUDDER CONTROL SYSTEM AND KAYAK

FIELD

The present invention relates to the technical field of watercraft, in particular to a tail rudder control system and a kayak.

BACKGROUND

Kayaking has gained more and more popularity as an overwater leisure sport. The tail of the kayak is usually provided with a rudder with the main purpose of steering actions of the kayak through the controlling of the rotation of the tail rudder. The current tail rudder is mainly arranged in two ways; one is directly mounted on the stern of the boat body through a fixing frame that can slide horizontally. When in use, the tail rudder swing left and right and is always in a suspension state when not used; the other one is likewise mounted on the stern of the boat body, able to swing horizontally, and tilt backwards and hang on the stern when not in use.

It is apparent that, the latter is obviously superior to the former in terms of convenience, aesthetics and other aspects, however the latter tilting backwards and directly hanging on the stern has also presented various disadvantages, such as affecting the overall aesthetics, potential damage of the tail rudder due to collision when not used, possibility to scratch people and things and etc. Therefore, the tail rudder is considered to be stored in an accommodating space reserved at the bottom of the boat body after it is turned over, which brought about a problem that usually the tail rudder is not in the initial vertical position after use, and it is easy to hit the bottom of the boat during the storage process by directly turning the downside up, thus causing damage to the tail rudder and the bottom of the boat in the long run.

SUMMARY

In view of the problems existing in the prior art, the invention provides a tail rudder control system and a kayak which effectively achieves the purpose of installing a retractable tail rudder on the bottom surface of a boat and avoids collision with the bottom of the boat during the taking-in process of the tail rudder to overcome the technical defects.

According to the invention there is provided a tail rudder control system, applied to a boat. The tail rudder control system has a tail rudder assembly which includes a tail rudder, a swing mechanism for driving the tail rudder to rotate left and right in the horizontal direction, a traction mechanism for driving the tail rudder to flip longitudinally into the bottom of the boat, and a guide wheel box for driving the swing mechanism and reset the tail rudder to the initial position. Two oppositely-arranged pedal assemblies are provided, respectively in transmission connection with the swing mechanism through a steering traction line for driving the swing mechanism to act. A transmission assembly includes a first transmission wheel wound with a transmission traction line and a second transmission wheel wound with a reverse traction line. The second transmission wheel is driven by the first transmission wheel. The reverse traction line is in transmission connection with the traction mechanism for driving the traction mechanism to act. The transmission traction line is in transmission connection with the guide wheel box for driving the guide wheel set in the guide wheel box to act. A manual control assembly is provided with the transmission traction line penetrating into the manual control assembly, and the manual control assembly drives the transmission traction line to act.

Preferably, each pedal assembly includes a first base, a stepping board rotatably mounted on the first base, an elastic member for resetting the stepping board, and at least one winding column on the stepping board, and the steering traction line is wound on the winding column.

Preferably, an adjusting screw is rotatably mounted on the first base horizontally; one end of the adjusting screw is connected with an adjusting handle, and a sliding seat is also horizontally and slidably mounted on the first base. The adjusting screw passes through the sliding seat to be in tooth-fit connection with the sliding seat, and the stepping board is rotatably mounted on the sliding seat.

Preferably, the transmission assembly includes a transmission wheel box formed by splicing an upper cover and a lower shell, and two first transmission wheels and a second transmission wheel are rotatably mounted in the inner cavity of the transmission wheel box. The second transmission wheel is clamped between the two first transmission wheels. A first pin further penetrates the first transmission wheel longitudinally; the opposite end surfaces of the two first transmission wheels are respectively recessed to form a waist-shaped groove, and the two ends of the first pin insert into the waist-shaped groove respectively and can move along the waist-shaped groove.

Preferably, the transmission traction line winds around the guide wheel in the manual control assembly, the outer periphery of one of the first transmission wheels, the guide wheel set in the guide wheel box, the outer periphery of the other one of the first transmission wheels in sequence and re-enters the manual control assembly to form a closed circle.

Preferably, the tail rudder assembly includes a second base, fixed at the bottom of the boat, a rudder housing which is installed on the second base, and an accommodating space with an opening at the lower end formed inside the rudder housing for the storage of the tail rudder. A traction mechanism, including a steering wheel, is rotatably installed on the second base, a retractable guide wheel rotatably and longitudinally installed below the steering wheel, and the steering wheel is able to perform a steering action under the transmission of the swing mechanism; the reverse traction line winds around the periphery of the retractable guide wheel to drive the retractable guide wheel to rotate. The tail rudder, is longitudinally and fixedly connected to the retractable guide wheel and can be driven by the retractable guide wheel to flip downwards to extend out and flip upwards to extend into the accommodating space. The guide wheel box is mounted on the second base and internally provided with a guide wheel set. The swing mechanism is located inside the guide wheel box, and the guide wheel set can drive the swing mechanism to perform a reset action.

Preferably, the swing mechanism includes a steering swing arm fixedly connected to the steering wheel, swing arm columns fixedly connected to the lower side surface of the two ends of the steering swing arm, two steering traction lines are respectively connected to the two ends of the steering swing arm, and the guide wheel set includes four straightening cams, every two straightening cams form a cam group. The two cam groups are arranged on the left and right side of the steering wheel. The rotation directions of the two straightening cams in each cam group are opposite, and the upper end surface of each straightening cam is provided with a convex surface abutting against the swing arm column in the rotation process and resetting the steering swing arm.

Preferably, the manual control assembly includes a bracket seat, a guide wheel rotatably mounted at the front end of the bracket seat, and a retractable button. The transmission traction line inserts into the rear end of the bracket seat, winds around the guide wheel and again extends out from the rear end of the bracket seat. The retractable button is fixedly connected to the transmission traction line and located in the bracket seat for driving the transmission traction line to act by moving the retractable button back and forth.

Preferably, a transfer assembly is arranged between the manual control assembly and the transmission assembly, and the transfer assembly includes a box body spliced by an upper casing and a lower casing, a first guide wheel and a second guide wheel rotatably mounted in the box body, and a slider able to slide inside the box body. The part of the transmission traction line connected with the manual control assembly inserts into the front end of the box body, winds around the first guide wheel and extends out of the front end of the box body after connecting the slider. The part of the transmission traction line connected with the transmission assembly inserts into the rear end of the box body, winds around the second guide wheel and extends out of the rear end of the box body after connecting the slider.

The invention further provides a kayak, which includes a boat body and a tail rudder control system as described above. The pedal assembly and the transmission assembly of the tail rudder control system are fixedly installed on the inner side wall of the boat body. The tail rudder assembly of the tail rudder control system is installed at the tail of the boat body, and the tail rudder of the tail rudder assembly can flip downwards to extend out of the bottom surface of the boat body and flip upwards to be stored in the ship body.

The tail rudder control system includes the tail rudder assembly, the pedal assembly, the transmission assembly and the manual control assembly which are in transmission connection with each other through the steering traction line, the transmission traction line and the reverse traction line, so that the tail rudder can be controlled to swing left and right through the pedal assembly. The extending-out and unfolding action, the horizontal resetting action and the longitudinal resetting action of the tail rudder are achieved through the manual control assembly, the transmission assembly and the tail rudder assembly. The purpose of retractable mounting the tail rudder on the bottom surface of the boat is effectively achieved, and the potential problem of collision with the bottom of the boat during the storage process of the tail rudder effectively avoided.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
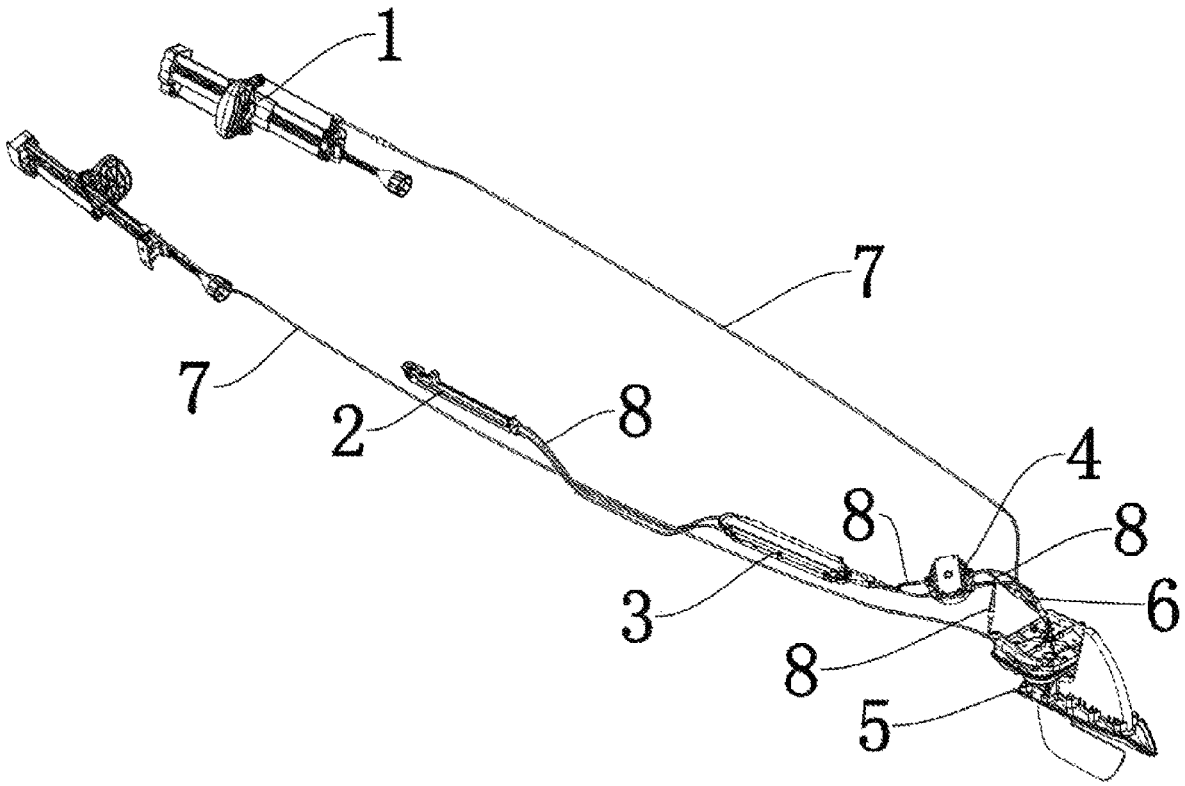
FIG. 1 is a perspective view of the tail rudder control system of the present invention.

Illustrative embodiments will now be described with reference to FIG. 1 through FIG. 13.

Embodiment 1

As shown in FIG. 1 to FIG. 12, the tail rudder control system provided in the present invention is applied to boats and it consists of: The tail rudder assembly 5, with the tail rudder 52, the swing mechanism 54 for driving the tail rudder 52 to rotate left and right in the horizontal direction, the traction mechanism 56 for driving the tail rudder 52 to flip longitudinally into the bottom of the boat, and the guide wheel box 55 for driving the swing mechanism 54 and reset the tail rudder 52 to the initial position.

Two oppositely-arranged pedal assemblies 1, respectively in transmission connection with the swing mechanism 54 through the steering traction line 7 for driving the swing mechanism 54 to act. In this embodiment, the two pedal assemblies 1 are arranged in a mirror symmetry.

The transmission assembly 4, has the first transmission wheel 43 wound with the transmission traction line 8, the second transmission wheel 44 wound with the reverse traction line 6; the second transmission wheel 44 is driven by the first transmission wheel 43, and the reverse traction line 6 is in transmission connection with the traction mechanism 56 for driving the traction mechanism 56 to act, the transmission traction line 8 is in transmission connection with the guide wheel box 55 for driving the guide wheel set in the guide wheel box 55 to act.

The manual control assembly 2, the transmission traction line 8 penetrates into the manual control assembly 2, and the manual control assembly 2 drives the transmission traction line 8 to act.

Based on the above technical solution, the tail rudder control system includes the tail rudder assembly 5, the pedal assembly 1, the transmission assembly 4 and the manual control assembly 2 which are in transmission connection with each other through the steering traction line 7, the transmission traction line 8 and the reverse traction line 6, so that the tail rudder 52 can be controlled to swing left and right through the pedal assembly 1. The extending-out and unfolding action, the horizontal resetting action and the longitudinal resetting action of the tail rudder 52 are achieved through the manual control assembly 2, the transmission assembly 4 and the tail rudder assembly 5, and the purpose of retractable mounting the tail rudder on the bottom surface of the boat is effectively achieved, and the potential problem of collision with the bottom of the boat during the storage process of the tail rudder effectively avoided.

Figure 2:
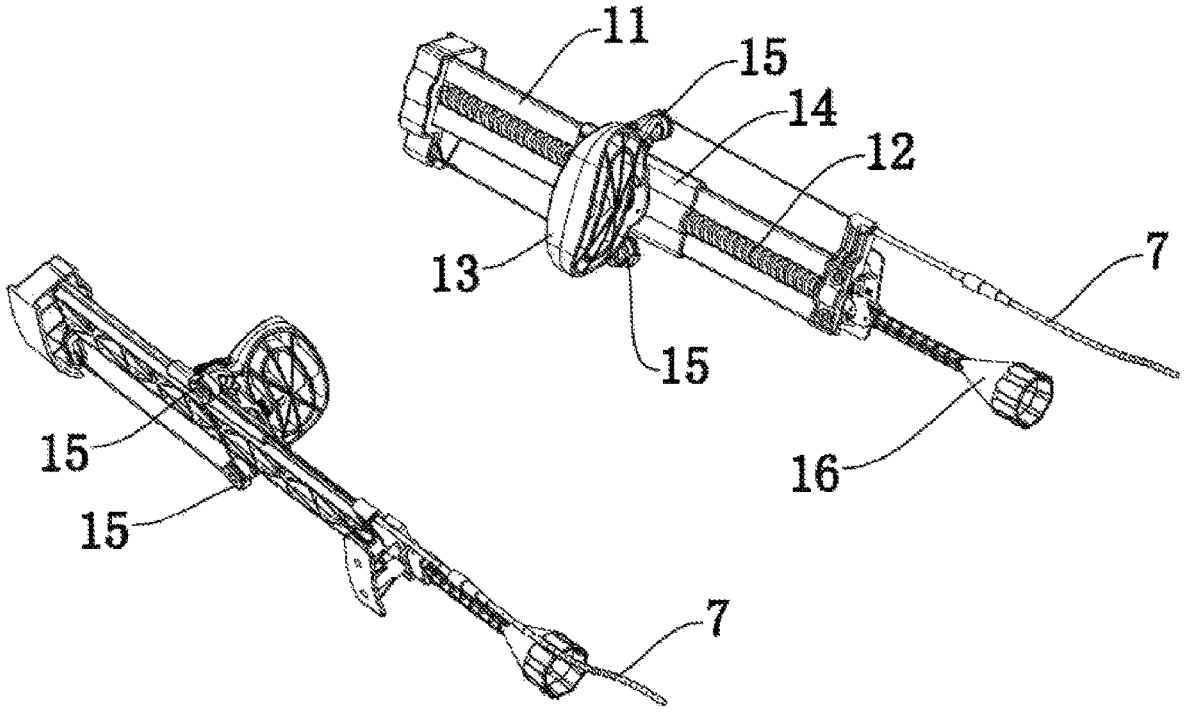
FIG. 2 is a perspective view of the pedal assembly in the tail rudder control system of the present invention.
Figure 3:
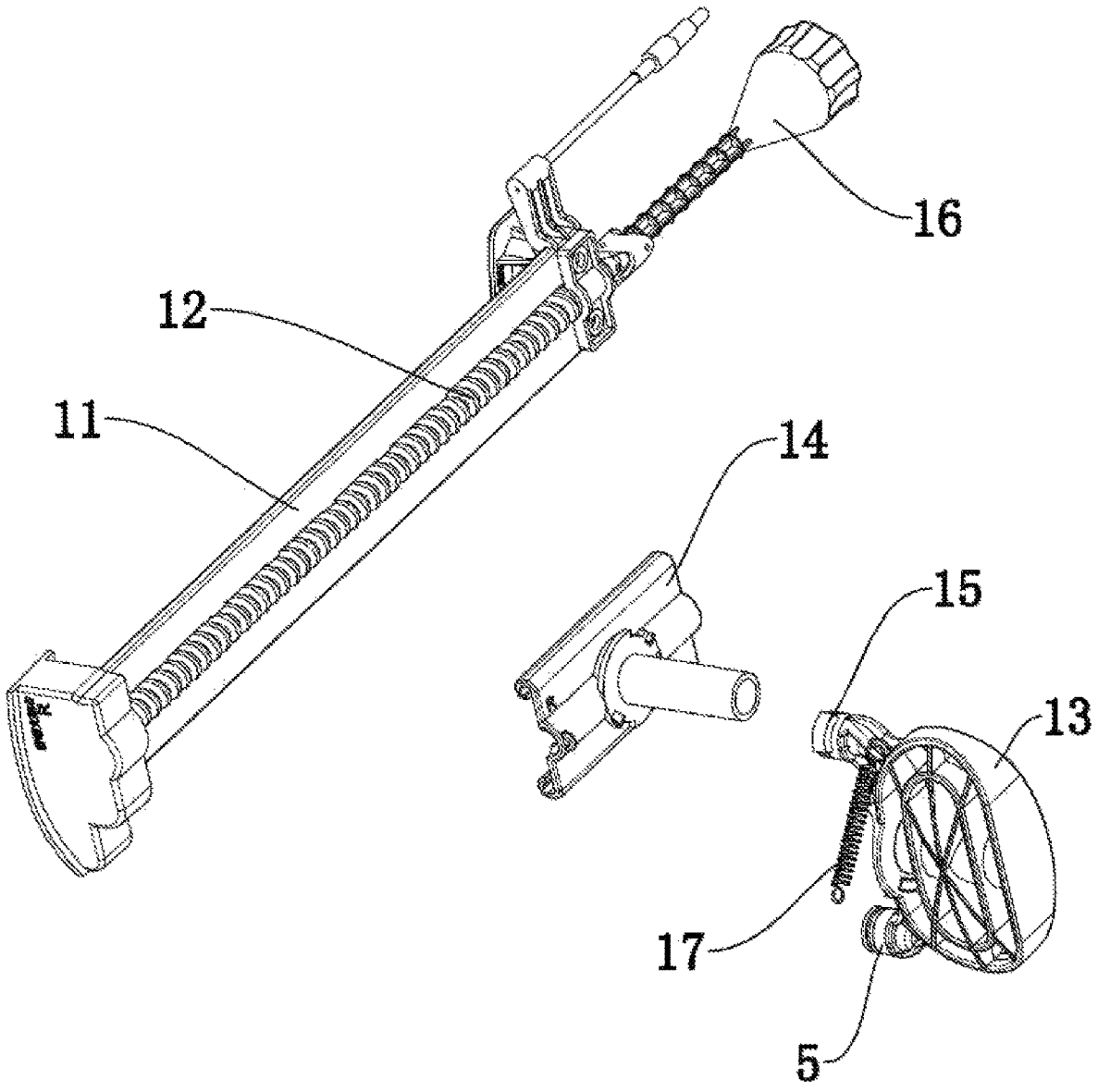
FIG. 3 is an exploded view of the pedal assembly in the tail rudder control system of the present invention.

In a preferred embodiment, as shown in FIG. 2 and FIG. 3, each pedal assembly 1 includes the first base 11, the stepping board 13 rotatably mounted on the first base 11, the elastic member 17 for resetting the stepping board 13, and at least one winding column 15 on the stepping board 13, and the steering traction line 7 is wound on the winding column 15 to enable the stretching control of the steering traction line 7 by stamping the stepping board 13 and the stepping board 13 to be reset to the initial position by the elastic member 17 after the user releases his or her foot. Further, the adjusting screw 12 is rotatably mounted on the first base 11 horizontally; one end of the adjusting screw 12 is connected with an adjusting handle 16, and the sliding seat 14 is also horizontally and slidably mounted on the first base 11. The adjusting screw 12 passes through the sliding seat 14 to be in tooth-fit connection with the sliding seat 14, and the stepping board 13 is rotatably mounted on the sliding seat 14, thus the horizontal position of the sliding seat 14 on the first base 11 can be adjusted by the adjusting handle 16, and then the position of the stepping board 13 is adjusted, so that the user can adjust the stepping board 13 to an appropriate position according to the length of his or her leg. Specifically, the number of the winding column 15 is two, and the steering traction line 7 sequentially winds around the two winding columns 15 and is fixed to one end of the first base 11. The above-mentioned elastic member 17 is a tension spring, and the two ends thereof are respectively connected to the stepping board 13 and the sliding seat 14. The sliding seat 14 is provided with a hole laterally, and the hole has an internal thread matching with the external thread of the outer periphery of the adjusting screw 12. The two ends of the first base 11 are provided with mounting blocks for fixing it to the inner wall of the boat.

In a preferred embodiment, as shown in FIGS. 6-9, the transmission assembly 4 includes the transmission wheel box formed by splicing an upper cover 41 and a lower shell 42, and two first transmission wheels 43 and the second transmission wheel 44 are rotatably mounted in the inner cavity of the transmission wheel box; the second transmission wheel 44 is clamped between the two first transmission wheels 43; the first pin 47 further penetrates the first transmission wheel 43 longitudinally; the opposite end surfaces of the two first transmission wheels 43 are respectively recessed to form a waist-shaped groove 431, and the two ends of the first pin 47 insert into the waist-shaped groove 431 respectively and can move along the waist-shaped groove 431.

Specifically, when the transmission traction line 8 is driven by the manual control assembly 2 to act, it further moves the first transmission wheel 43 to act, and two steps are performed next, which are a pre-step and a subsequent step. The pre-step is: the first transmission wheel 43 rotates a distance no more than the arc length of the waist-shaped groove 431 during which the second transmission wheel 44 remains stationary, and the actions of the first transmission wheel 43 and the transmission traction line 8 cause the guide wheel set in the guide wheel box 55 to act which at this stage enables the tail rudder 52 to be reset from shifted left or right due to usage. The subsequent step is: after the first transmission wheel 43 rotates to the ends of both sides of the waist-shaped groove 431 to abut against the first pin 47, the rotation continues to drive the second transmission wheel 44 synchronously, which in turn drives the reverse traction line 6 to act and further transmits the action to the traction mechanism 56 and drives the tail rudder 52 to flip vertically to be stored at the bottom of the boat. Therefore, the horizontal reset of the tail rudder 52 and the longitudinal reset of the tail rudder 52 are sequentially performed when the manual control assembly 2 is operated, which can effectively avoid the problem that the rudder 52 may collide with the bottom of the boat during the storage process.

In a further preferred embodiment, two first transmission wheels 43 and the second transmission wheel 44 are coaxially provided with a transmission wheel shaft 46, and the upper and lower ends of the transmission wheel shaft 46 are fixedly connected to the upper cover 41 and the lower case 42 respectively. Further, a recessed surface is formed on the opposite end surfaces of the two first transmission wheels 43 respectively, and the upper and lower ends of the second transmission wheel 44 are respectively and partially accommodated in the recessed surface, making it difficult to come off.

Figure 12:
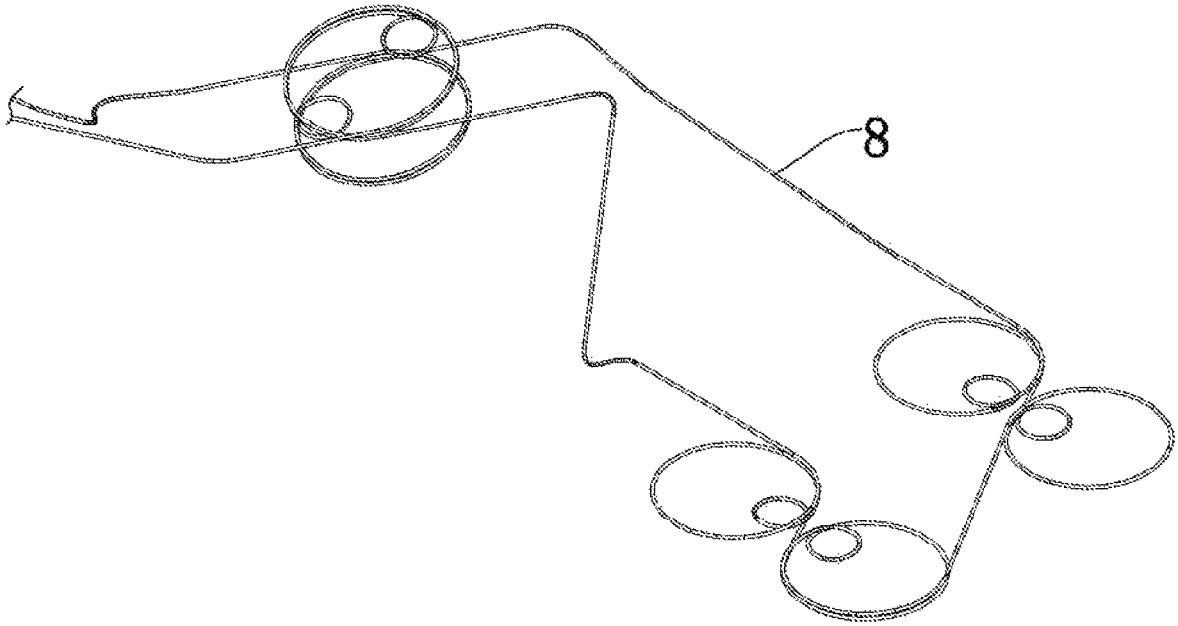
FIG. 12 is an independent perspective view of the transmission line wound in the tail rudder control system of the present invention.

Further, as shown in FIG. 12, the transmission traction line 8 sequentially winds around the guide wheel 22 in the manual control assembly 2, the outer periphery of one of the first transmission wheels 43, the guide wheel set in the guide wheel box 55, the outer periphery of the other one of the first transmission wheels 43 and enters into the manual control assembly 2 again to form a closed circle, so that the rotation directions of the first transmission wheels 43 and the guide wheel set can be controlled by the rotation direction of the guide wheel 22 in the hand control assembly 2. Further, the second transmission wheel 44 and each of the first transmission wheel 43 are provided with a circular groove, a notch opposite to the circular groove position and extending to the outer peripheral wall, a winding pole is erected in the circular groove. The traction line inserts into the circular groove through the notch in the process of winding the periphery of the transmission wheel and the traction line winds around the winding pole for at least one round and extends out from the notch, which achieved the effects of preventing slipping and being more stable in the transmission process in a specific use. Further, the second transmission wheel 44, and each of the first transmission wheels 43 are further provided with a threaded groove adjacent to the circular groove, the threaded groove is internally provided with a fastener, and when the traction line inserts into the circular groove and winds around the winding pole, the traction line is pressed tightly by the cap part of the fastener so as to prevent the traction line from falling upwards. The upper end surface of the upper cover 41 is also connected with a mounting bracket 45 for fixing it to the inner side wall of the boat.

Figure 10:
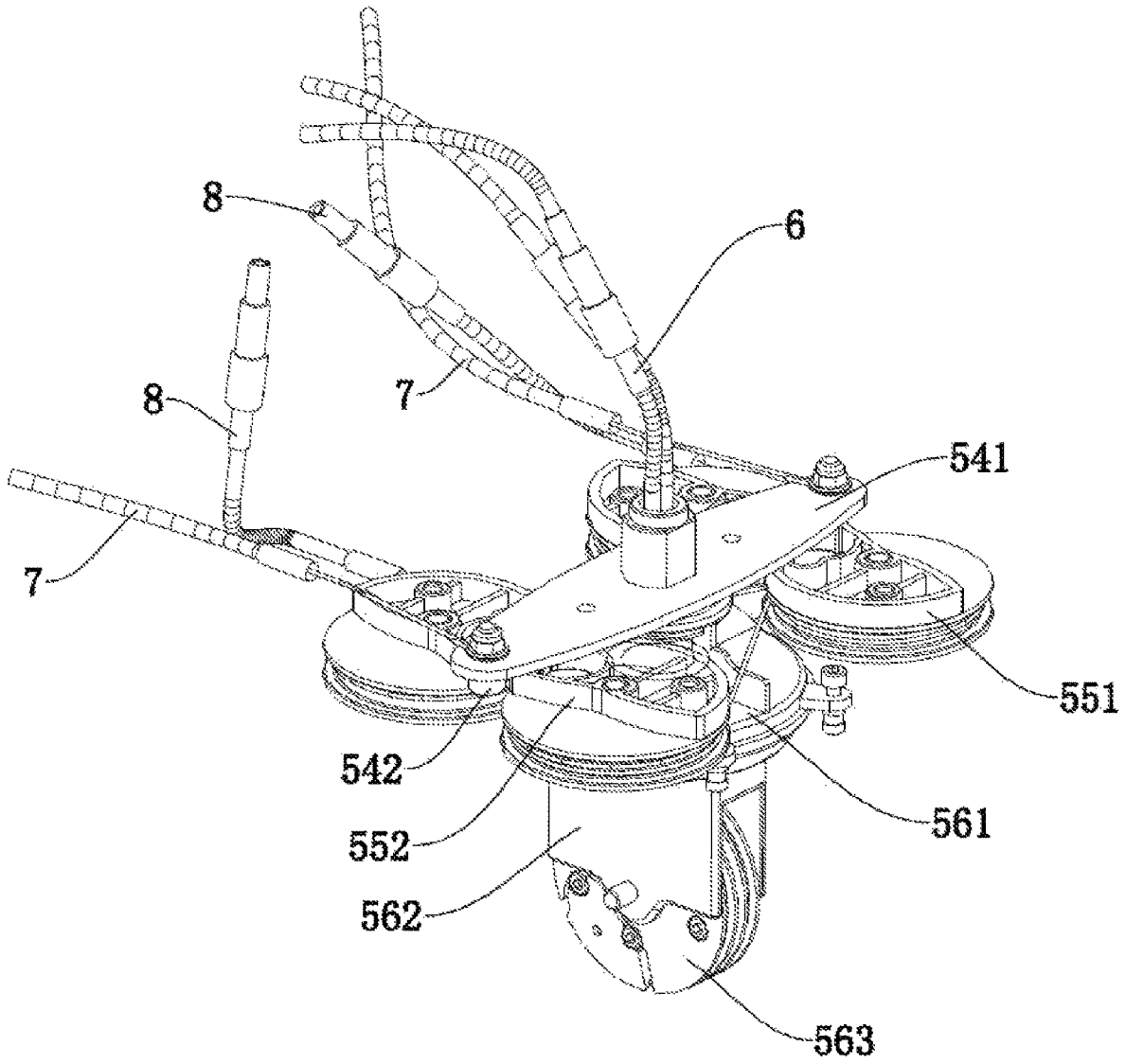
FIG. 10 is a perspective view of the internal structure of the tail rudder assembly in the tail rudder control system of the present invention.
Figure 11:
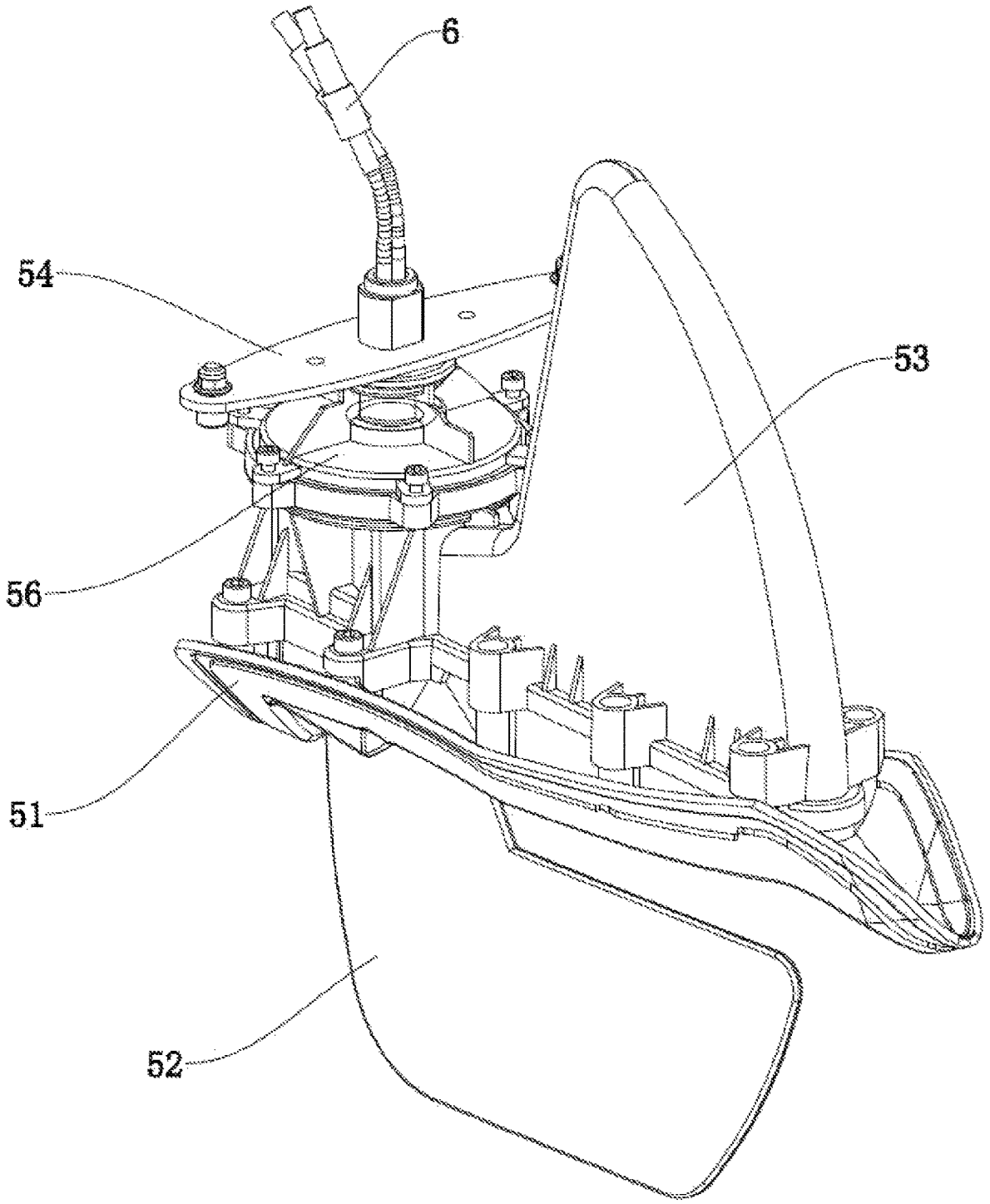
FIG. 11 is a perspective view of the tail rudder transmission structure in the tail rudder assembly in the tail rudder control system according to the present invention.

In a preferred embodiment, as shown in FIG. 10 and FIG. 11, the tail rudder assembly 5 includes: The second base 51, fixed at the bottom of the boat, the rudder housing 53 which is installed on the second base 51, and an accommodating space with an opening at the lower end formed inside the rudder housing 53 for the storage of the tail rudder 52.

The traction mechanism 56, includes a steering wheel 561 rotatably installed on the second base 51, the retractable guide wheel 563 rotatably and longitudinally installed below the steering wheel 561, and the steering wheel 561 is able to perform a steering action under the transmission of the swing mechanism 54. The reverse traction line 6 winds around the periphery of the retractable guide wheel 563 to drive the retractable guide wheel 563 to rotate.

The tail rudder 52, is longitudinally and fixedly connected to the retractable guide wheel 563 and can be driven by the retractable guide wheel 563 to flip downwards to extend out and flip upwards to extend into the accommodating space.

The guide wheel box 55, is mounted on the second base 51 and internally provided with a guide wheel set; the swing mechanism 54 is located inside the guide wheel box 55, and the guide wheel set can drive the swing mechanism 54 to perform a reset action. Based on the above structure, the reverse traction line 6 and the retractable guide wheel 563 drive the tail rudder 52 to flip vertically, so that it can be deployed downwards to the use state and flip upwards to be stored in the accommodating space.

In a further preferred embodiment, the swing mechanism 54 includes the steering swing arm 541 fixedly connected to the steering wheel 561, swing arm columns 542 fixedly connected to the lower side surface of the two ends of the steering swing arm 541, two steering traction lines 7 are respectively connected to the two ends of the steering swing arm 541, and the guide wheel set includes four straightening cams 551, every two straightening cams 551 form a cam group; the two cam groups are arranged on the left and right side of the steering wheel 561. The rotation directions of the two straightening cams 551 in each cam group are opposite, realized by the different winding directions of the transmission traction line 8; and the upper end surface of each straightening cam 551 is provided with a convex surface 552 abutting against the swing arm column 542 in the rotation process and resetting the steering swing arm 541. Specifically shown in FIG. 10, when the steering swing arm 541 is driven to move by the act of the pedal assembly 1, it further performs the steering of the tail rudder 52; and when the tail rudder 52 needs to be retracted, firstly, in the above-mentioned pre-step, the four straightening cams 551 rotates accordingly, and after the convex surfaces 552 of the two straightening cams 551 abut against the swing arm columns 542, it moves further to drive the steering swing arm 541 to return to the initial position. In this action, the tail rudder 52 rotates horizontally to return to the initial position though the steering swing arm 541 and the steering wheel 561 in sequence; then, in the subsequent step as described above, the reverse traction line 6 acts to drive the retractable guide wheel 563 to move, which further drive the tail rudder flip upward vertically to be stored in the accommodating space.

In a further preferred embodiment, a bracket 562 having an "n" shape is mounted on the lower end surface of the steering wheel 561, and the retractable guide wheel 563 is rotatably mounted on the bracket 562 in a longitudinal direction through a pin shaft. In addition, the four straightening cams 551 also have a structure such as a circular groove, a notch, a winding pole, a threaded groove, and a fastener provided on the above-mentioned transmission wheel, and the structures are the same, so detailed description is omitted here. Further, the steering swing arm 541 has a plate-shaped structure as a whole; the upper end of the steering wheel 561 passes through the middle of the steering swing arm 541 and the steering wheel 561 has a central hole penetrating longitudinally; the reverse traction line 6 passes through the central hole to wind on the retractable guide wheel 563.

In a preferred embodiment, as shown in FIGS. 1-4, the manual control assembly 2 includes the bracket seat 21, the guide wheel 22 rotatably mounted at the front end of the bracket seat 21, and a retractable button 23. The transmission traction line 8 inserts into the rear end of the bracket seat 21, winds around the guide wheel 22 and again extends out from the rear end of the bracket seat 21. The retractable button 23 is fixedly connected to the transmission traction line 8 and located in the bracket seat 21 for driving the transmission traction line 8 to act by moving the retractable button 23 back and forth. Specifically, the retractable button 23 can also be a rocker provided on the side of the guide wheel 22. The guide wheel 22 is manually controlled to rotate to move the transmission traction line 8 and further transmit the action to the transmission assembly 4 to drive the two first transmission wheels 43 to rotate. It is worth pointing out that in combination with the above structure, turning the retractable button 23 to one direction to drive the tail rudder 52 to perform an unfolding action, and resetting the button to the other direction to drive the tail rudder 52 to first perform a horizontal reset and a longitudinal reset.

Figure 4:
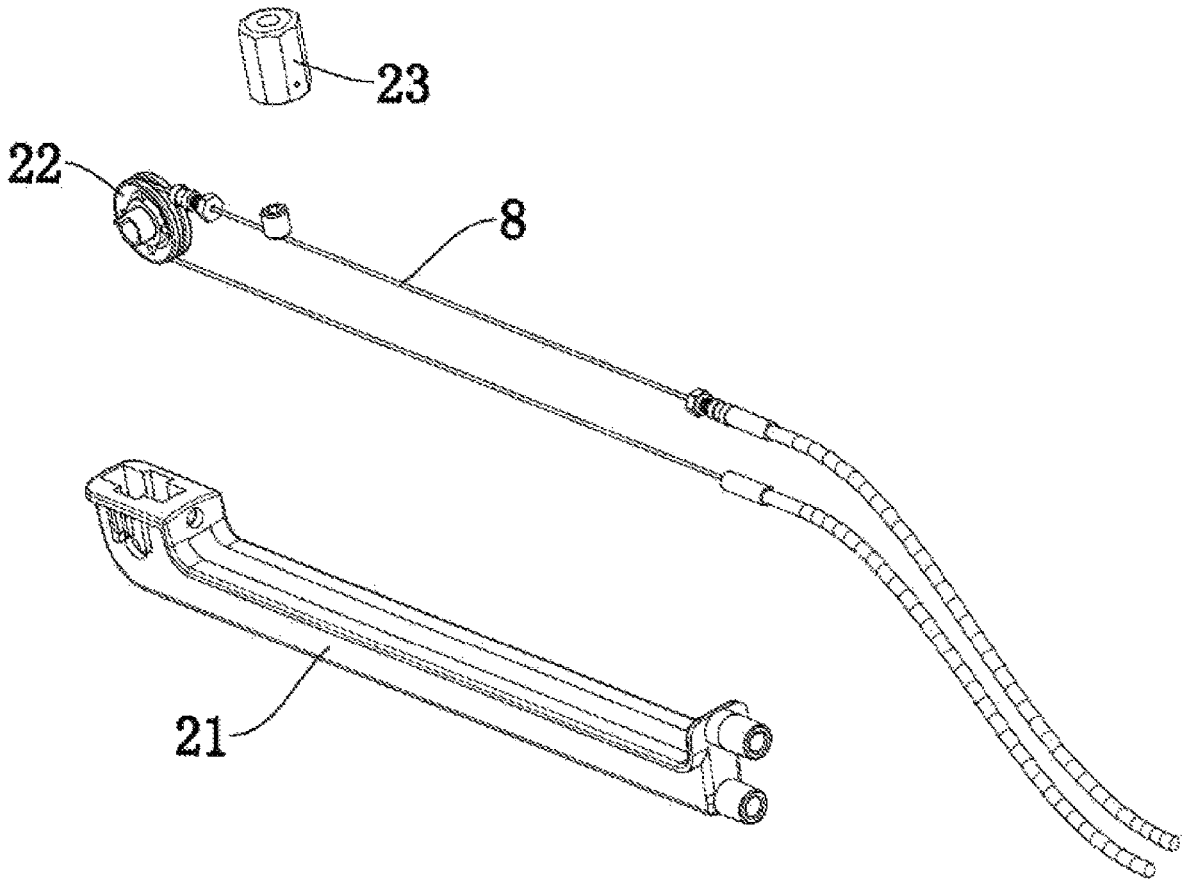
FIG. 4 is an exploded view of the manual control assembly in the tail rudder control system of the present invention.
Figure 5:
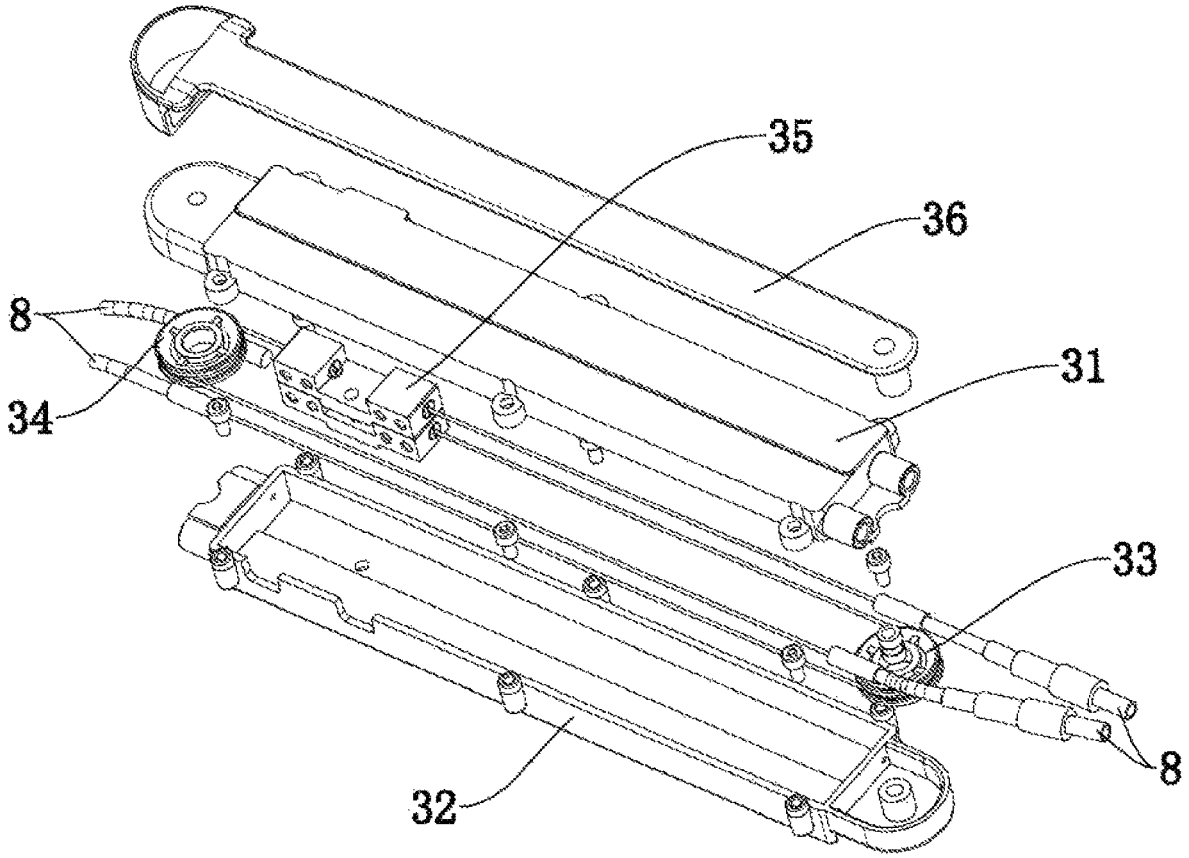
FIG. 5 is an exploded view of the transfer assembly in the tail rudder control system of the present invention.
Figure 6:
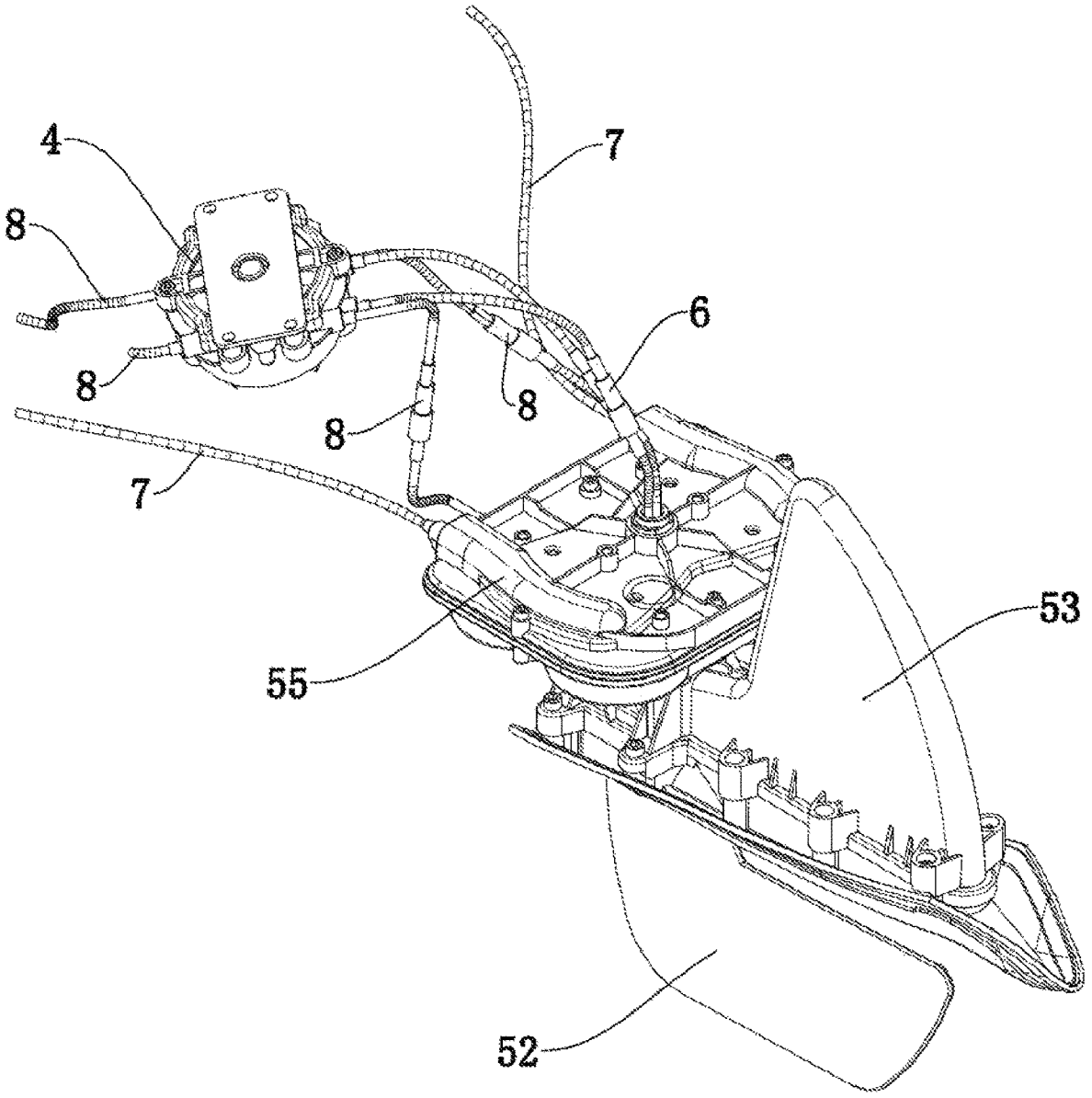
FIG. 6 is a perspective view of the transmission assembly and the tail rudder assembly in the tail rudder control system of the present invention.
Figure 7:
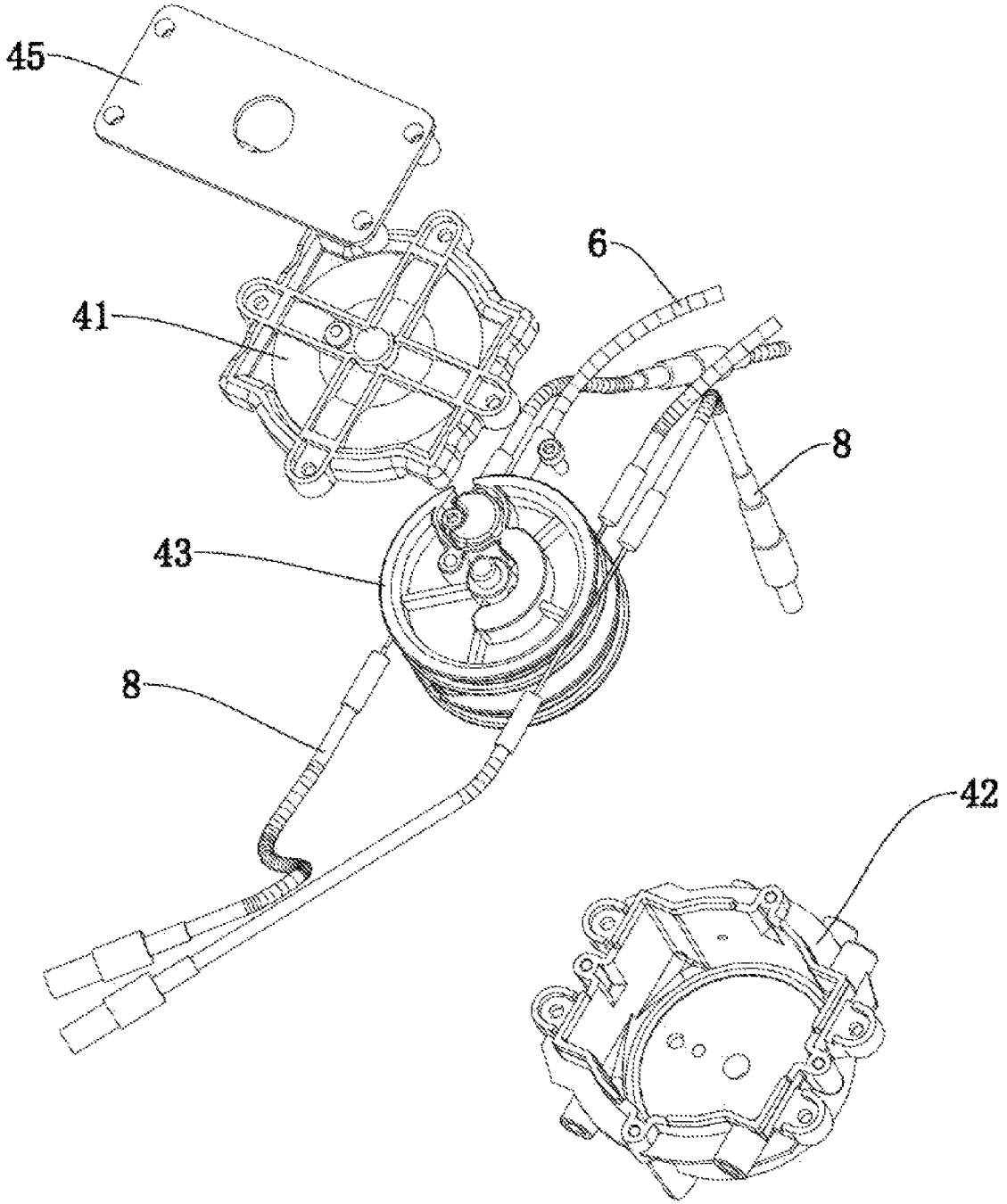
FIG. 7 is an exploded view of the transmission assembly in the tail rudder control system of the present invention.
Figure 8:
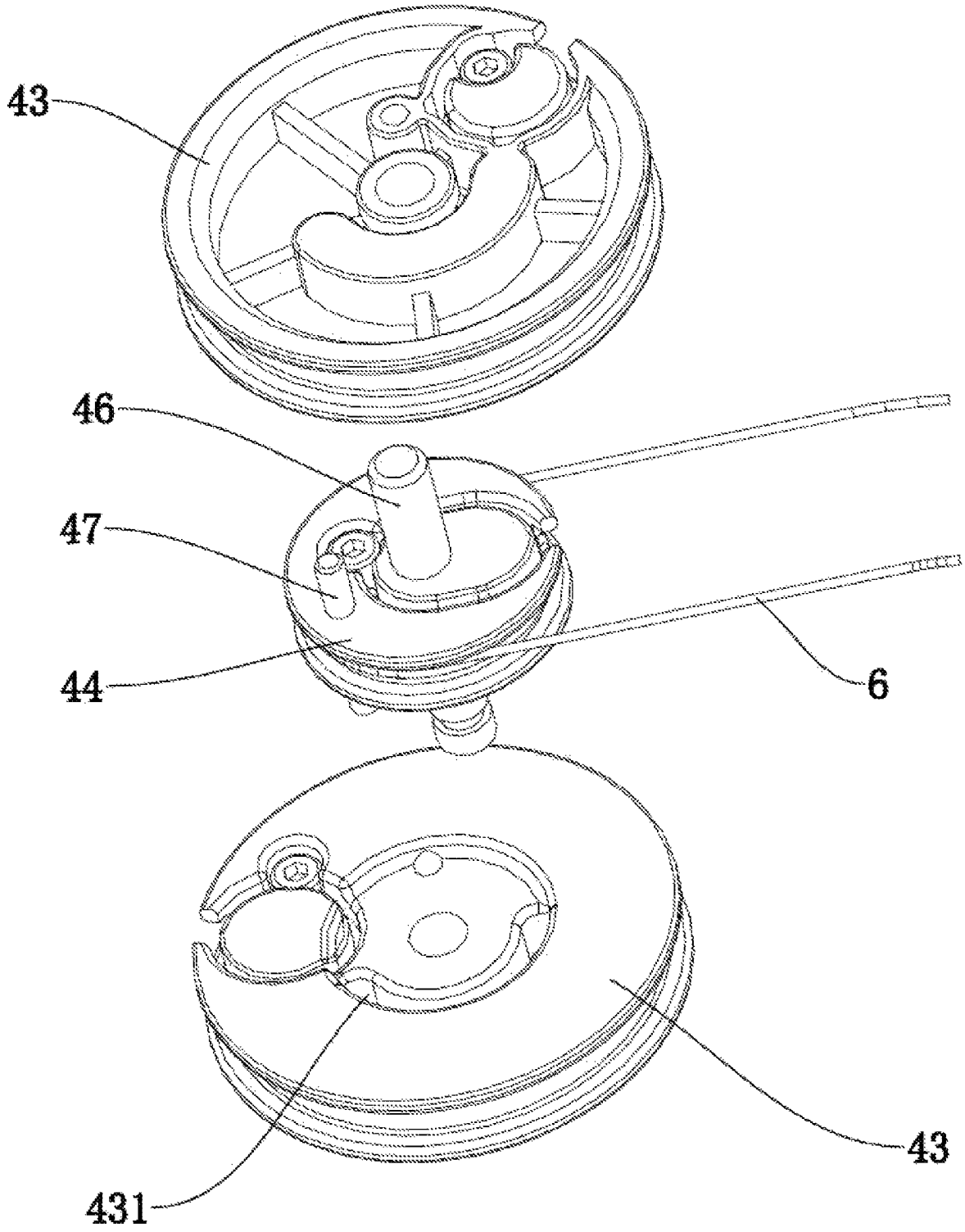
FIG. 8 is an exploded view of the guide wheel set in the transmission assembly in the tail rudder control system of the present invention.
Figure 9:
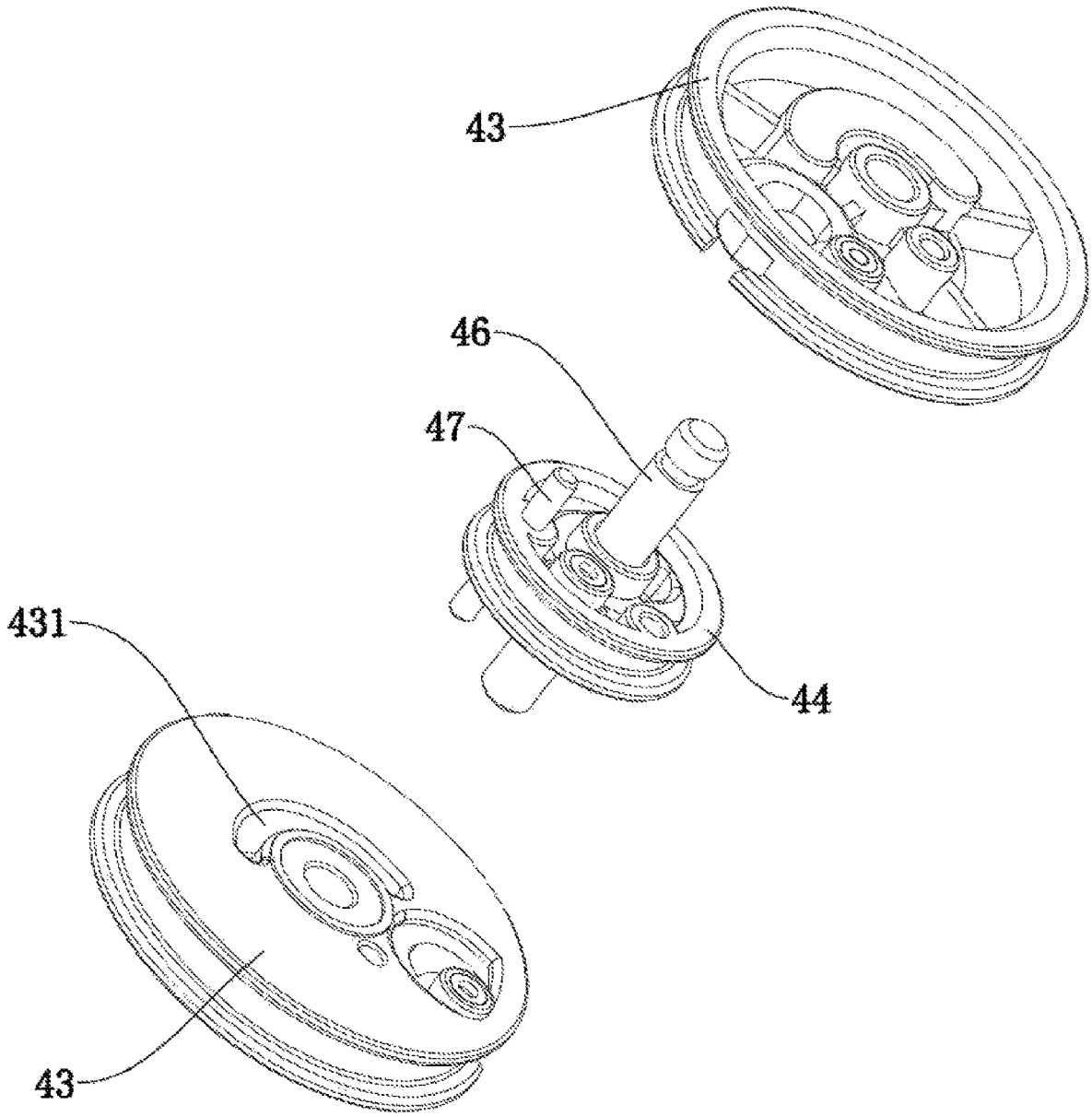
FIG. 9 is an exploded view of the guide wheel set in the transmission assembly in the tail rudder control system of the present invention from another perspective.

In a further preferred embodiment, as shown in FIG. 4 and FIG. 5, the tail rudder control system further includes a transfer assembly 3 arranged between the manual control assembly 2 and the transmission assembly 4, and the transfer assembly 3 includes a box body spliced by an upper casing 31 and a lower casing 32, the first guide wheel 33 and the second guide wheel 34 rotatably mounted in the box body, and the slider 35 able to slide inside the box body. The part of the transmission traction line 8 connected with the manual control assembly 2 inserts into the front end of the box body, winds around the first guide wheel 33 and extends out of the front end of the box body after connecting the slider 35. The part of the transmission traction line 8 connected with the transmission assembly 4 inserts into the rear end of the box body, winds around the second guide wheel 34 and extends out of the rear end of the box body after connecting the slider 35. The whole transmission process is transmitted through the two guide wheels and the slider 35 in the box body, so that the transmission is more stable and reliable. Besides, the upper end surface of the upper casing 31 is also connected with a mounting bracket for fixing it to the inner wall of the boat. The above-mentioned transmission traction line, steering traction line, and reverse traction line are all steel wire ropes, but they are not limited thereto.

Embodiment 2

Figure 13:
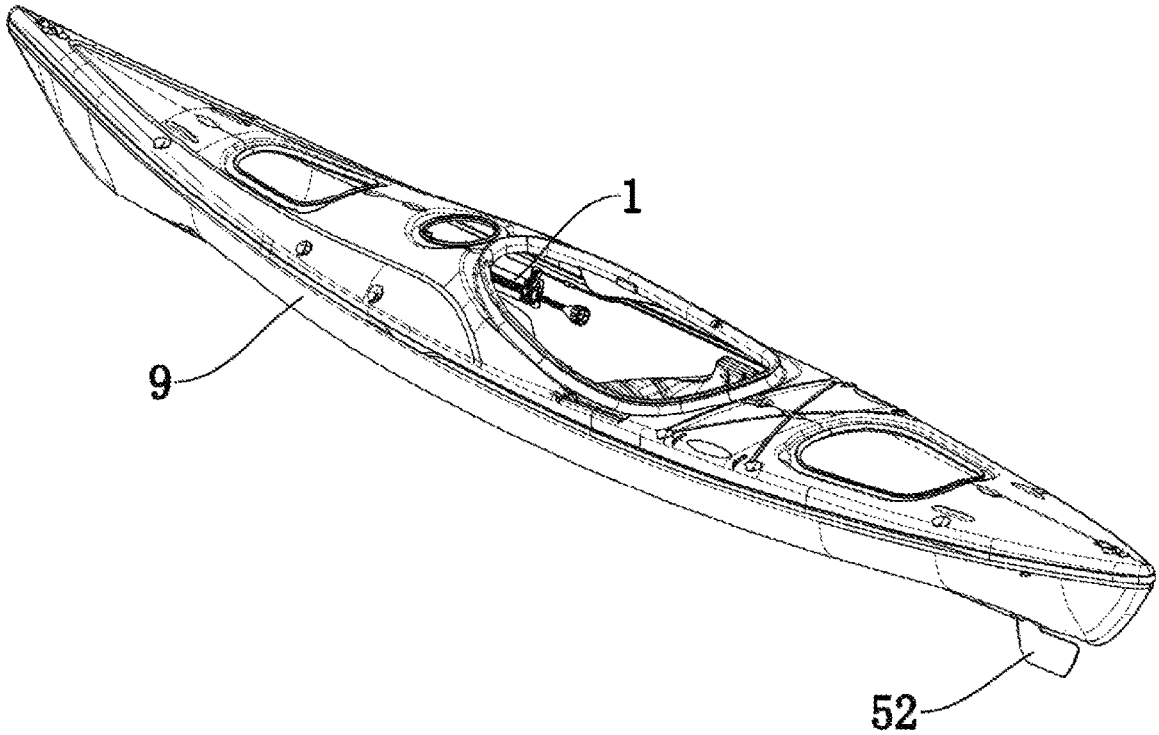
FIG. 13 is a perspective view of the kayak of the present invention.

Referring to FIG. 13, the kayak in this embodiment includes the boat body 9 and a tail rudder control system as described above; the pedal assembly 1 and the transmission assembly 4 of the tail rudder control system are fixedly installed on the inner side wall of the boat body 9. The tail rudder assembly 5 of the tail rudder control system is installed at the tail of the boat body 9, and the tail rudder 52 of the tail rudder assembly can flip downwards to extend out of the bottom surface of the boat body 9 and flip upwards to be stored in the ship body 9.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A tail rudder control system, applied to a boat, wherein the tail rudder control system comprises:

a tail rudder assembly, comprising a tail rudder, a swing mechanism for driving the tail rudder to rotate left and right in a horizontal direction, a traction mechanism for driving the tail rudder to flip longitudinally into a bottom of the boat, and a guide wheel box for driving the swing mechanism and reset the tail rudder to an initial position;

two oppositely-arranged pedal assemblies, respectively in transmission connection with the swing mechanism through a steering traction line for driving the swing mechanism to act;

a transmission assembly, comprising a first transmission wheel wound with a transmission traction line, a second transmission wheel wound with a reverse traction line; the second transmission wheel is driven by the first transmission wheel, and the reverse traction line is in transmission connection with the traction mechanism for driving the traction mechanism to act, the transmission traction line is in transmission connection with the guide wheel box for driving a guide wheel set in the guide wheel box to act; and a manual control assembly, the transmission traction line penetrates into the manual control assembly, and the manual control assembly drives the transmission traction line to act.

2. The tail rudder control system of claim 1, wherein each pedal assembly comprises a first base, a stepping board rotatably mounted on the first base, an elastic member for resetting the stepping board, and at least one winding column on the stepping board, and the steering traction line is wound on the winding column.

3. The tail rudder control system of claim 2, wherein an adjusting screw is rotatably mounted on the first base horizontally; one end of the adjusting screw is connected with an adjusting handle, and a sliding seat is also horizontally and slidably mounted on the first base; the adjusting screw passes through the sliding seat to be in tooth-fit connection with the sliding seat, and the stepping board is rotatably mounted on the sliding seat.

4. The tail rudder control system of claim 1, wherein the transmission assembly comprises a transmission wheel box formed by splicing an upper cover and a lower shell, and two first transmission wheels and a second transmission wheel are rotatably mounted in an inner cavity of the transmission wheel box; the second transmission wheel is clamped between the two first transmission wheels; a first pin further penetrates the first transmission wheel longitudinally; the opposite end surfaces of the two first transmission wheels are respectively recessed to form a waist-shaped groove, and the two ends of the first pin insert into the waist-shaped groove respectively and can move along the waist-shaped groove.

5. The tail rudder control system of claim 4, wherein the transmission traction line winds around a guide wheel in the manual control assembly, the outer periphery of one of the first transmission wheels, the guide wheel set in the guide wheel box, the outer periphery of the other one of the first transmission wheels in sequence and re-enters the manual control assembly to form a closed circle.

6. The tail rudder control system of claim 1, wherein the tail rudder assembly comprises a second base, fixed at the bottom of the boat, a rudder housing which is installed on the second base, and an accommodating space with an opening at a lower end formed inside the rudder housing for the storage of the tail rudder; a traction mechanism, comprising a steering wheel rotatably installed on the second base, a retractable guide wheel rotatably and longitudinally installed below the steering wheel, and the steering wheel is able to perform a steering action under the transmission of the swing mechanism; the reverse traction line winds around the periphery of the retractable guide wheel to drive the retractable guide wheel to rotate; the tail rudder, is longitudinally and fixedly connected to the retractable guide wheel and can be driven by the retractable guide wheel to flip downwards to extend out and flip upwards to extend into the accommodating space; the guide wheel box, mounted on the second base and internally provided with a guide wheel set; the swing mechanism is located inside the guide wheel box, and the guide wheel set can drive the swing mechanism to perform a reset action.

7. The tail rudder control system of claim 6, wherein the swing mechanism comprises a steering swing arm fixedly connected to a steering wheel, swing arm columns fixedly connected to a lower side surface of each of two ends of the steering swing arm, two steering traction lines are respectively connected to the two ends of the steering swing arm, and the guide wheel set comprises four straightening cams, every two straightening cams form a cam group; the two cam groups are arranged on the left and right side of the steering wheel; the rotation directions of the two straightening cams in each cam group are opposite, and an upper end surface of each straightening cam is provided with a convex surface abutting against the swing arm column in the rotation process and resetting the steering swing arm.

8. The tail rudder control system of claim 5, wherein the manual control assembly comprises a bracket seat, a guide wheel rotatably mounted at the front end of the bracket seat, and a retractable button; the transmission traction line inserts into a rear end of the bracket seat, winds around the guide wheel and again extends out from the rear end of the bracket seat; the retractable button is fixedly connected to the transmission traction line and located in the bracket seat for driving the transmission traction line to act by moving the retractable button back and forth.

9. The tail rudder control system of claim 8, wherein it further comprises a transfer assembly arranged between the manual control assembly and the transmission assembly, and the transfer assembly comprises a box body spliced by an upper casing and a lower casing, a first guide wheel and a second guide wheel rotatably mounted in the box body, and a slider able to slide inside the box body; the part of the transmission traction line connected with the manual control assembly inserts into a front end of the box body, winds around the first guide wheel and extends out of the front end of the box body after connecting the slider; and the part of the transmission traction line connected with the transmission assembly inserts into a rear end of the box body, winds around the second guide wheel and extends out of the rear end of the box body after connecting the slider.

10. A kayak, wherein the kayak comprises a boat body and the tail rudder control system of claim 1; the pedal assembly and the transmission assembly of the tail rudder control system are fixedly installed on a inner side wall of the boat body; the tail rudder assembly of the tail rudder control system is installed at a tail of the boat body, and the tail rudder of the tail rudder assembly can flip downwards to extend out of the bottom surface of the boat body and flip upwards to be stored in the boat body.

11. The tail rudder control system of claim 5, wherein the tail rudder assembly comprises a second base, fixed at the bottom of the boat, a rudder housing which is installed on the second base, and an accommodating space with an opening at a lower end formed inside the rudder housing for the storage of the tail rudder; a traction mechanism, comprising a steering wheel rotatably installed on the second base, a retractable guide wheel rotatably and longitudinally installed below the steering wheel, and the steering wheel is able to perform a steering action under the transmission of the swing mechanism; the reverse traction line winds around the periphery of the retractable guide wheel to drive the retractable guide wheel to rotate; the tail rudder, is longitudinally and fixedly connected to the retractable guide wheel and can be driven by the retractable guide wheel to flip downwards to extend out and flip upwards to extend into the accommodating space; the guide wheel box, mounted on the second base and internally provided with a guide wheel set; the swing mechanism is located inside the guide wheel box, and the guide wheel set can drive the swing mechanism to perform a reset action.

12. The tail rudder control system of claim 11, wherein the swing mechanism comprises a steering swing arm fixedly connected to the steering wheel, swing arm columns fixedly connected to a lower side surface of each of two ends of the steering swing arm, two steering traction lines are respectively connected to the two ends of the steering swing arm, and the guide wheel set comprises four straightening cams, every two straightening cams form a cam group; the two cam groups are arranged on the left and right side of the steering wheel; the rotation directions of the two straightening cams in each cam group are opposite, and an upper end surface of each straightening cam is provided with a convex surface abutting against the swing arm column in the rotation process and resetting the steering swing arm.

* * * * *